US008387683B2

(12) United States Patent
Yoshida et al.

(10) Patent No.: US 8,387,683 B2
(45) Date of Patent: Mar. 5, 2013

(54) STRUCTURE FOR PRODUCING CAST ARTICLES

(75) Inventors: Akira Yoshida, Aichi (JP); Masayuki Osaki, Tochigi (JP); Toshiki Matsuo, Aichi (JP); Tomofumi Kanzawa, Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/745,664

(22) PCT Filed: Jan. 15, 2009

(86) PCT No.: PCT/JP2009/050907

§ 371 (c)(1),
(2), (4) Date: Jun. 1, 2010

(87) PCT Pub. No.: WO2009/093621

PCT Pub. Date: Jul. 30, 2009

(65) Prior Publication Data

US 2010/0307714 A1 Dec. 9, 2010

(30) Foreign Application Priority Data

Jan. 22, 2008 (JP) ..... 2008-11114

(51) Int. Cl.
*B22C 9/00* (2006.01)
*B22C 9/10* (2006.01)

(52) U.S. Cl. ..... 164/527; 164/138; 164/369; 164/520; 164/526; 164/528

(58) Field of Classification Search ..... 164/520, 164/526, 527, 528, 138, 369
See application file for complete search history.

(56) References Cited

U.S. PATENT DOCUMENTS

| | | | | |
|---|---|---|---|---|
| 4,691,756 | A | 9/1987 | Suzuki et al. | |
| 6,939,526 | B2 * | 9/2005 | Fukuda et al. | 423/448 |
| 7,651,592 | B2 * | 1/2010 | Osaki | 162/218 |
| 2008/0026093 | A1 | 1/2008 | Osaki | |
| 2008/0105401 | A1 * | 5/2008 | Nakai et al. | 164/520 |

FOREIGN PATENT DOCUMENTS

| | | | |
|---|---|---|---|
| CN | 1953828 | A | 4/2007 |
| EP | 1 754 554 | A1 | 2/2007 |
| GB | 1281684 | A | 7/1972 |
| GB | EP 0062193 | A1 * | 10/1982 |
| JP | 62-45446 | A | 2/1987 |
| JP | 62-156044 | A | 7/1987 |
| JP | 7-96345 | A | 4/1995 |
| JP | 11-267789 | A | 10/1999 |
| JP | 2002-11544 | A | 1/2002 |

(Continued)

OTHER PUBLICATIONS

International Preliminary Report on Patentability and Written Opinion of the International Searching Authority mailed Aug. 31, 2010 for International Application No. PCT/JP2009/050907.

(Continued)

*Primary Examiner* — Devang R Patel
(74) *Attorney, Agent, or Firm* — Birch, Stewart, Kolasch & Birch, LLP

(57) ABSTRACT

The present invention provides a structure for producing cast articles containing one or more inorganic particles selected from amorphous and artificial graphites, an inorganic fiber and a thermosetting resin and having a gas permeability of 1 to 500.

16 Claims, 5 Drawing Sheets

FOREIGN PATENT DOCUMENTS

| | | | |
|---|---|---|---|
| JP | 2004-001083 | A | 1/2004 |
| JP | 3483033 | B2 | 1/2004 |
| JP | 2006-346747 | A | 12/2006 |
| JP | 2006-349428 | A | 12/2006 |
| JP | 2007-144511 | A | 6/2007 |
| WO | WO 2005/120745 | A1 | 12/2005 |

OTHER PUBLICATIONS

First Office Action for corresponding Chinese Patent Application No. 200980102833.6, dated Apr. 5, 2012.

Notification of the 2nd Office Action for corresponding Chinese Patent Application No. 200980102833.6, dated Oct. 22, 2012.

* cited by examiner

| Kind of graphite | Flake graphite 1 | Flake graphite 2 |
| --- | --- | --- |
| Microscopic photo picture |   |   |
| Analyzed image |   |   |
| Shape factor | 2.85 | 2.75 |

| Kind of graphite | Artificial graphite 1 | Artificial graphite 2 |
| --- | --- | --- |
| Microscopic photo picture |   |   |
| Analyzed image |   |   |
| Shape factor | 1.99 | 1.85 |

| Kind of graphite | Artificial graphite 3 | Amorphous graphite 1 |
| --- | --- | --- |
| Microscopic photo picture |   |   |
| Analyzed image |   |   |
| Shape factor | 1.78 | 2.05 |

STRUCTURE FOR PRODUCING CAST ARTICLES

FIELD OF THE INVENTION

The present invention relates to a structure for producing cast articles such as a mold used in casting. The present invention also relates to a method for producing the structure, a composition for the structure, a method for producing cast articles using the structure and use of the structure for producing cast articles.

BACKGROUND OF THE INVENTION

Cast articles are generally produced by forming a mold having a cavity therein with molding sand based on a wooden or metal pattern, optionally introducing a core to the cavity, and pouring molten metal into the cavity.

A sand mold is produced with molding sand by adding usual sand and a binder for hardening the sand to retain a shape, and thus used sand requires a reconditioning process for recycling. Further, there is a problem of generation of waste material such as dust during the reconditioning process. In the case of using a core of sand mold, in addition to the problem, there are problems of difficulty in handling the core due to a weight of the core itself and requirement of contradictory performances of strength retention during casting and removability of the core after casting.

To solve such problems, those techniques have been known, including a method for producing a structure for producing cast articles containing organic fibers, inorganic fibers, inorganic particles and a thermosetting resin, which the structure is lightweight, has good processability, and reduces waste (JP-A 2005-349428, WO-A 2005/120745, EP-A 1 754 554).

JP-A2007-144511 discloses a structure for producing cast articles containing flake graphite having an average particle diameter of 70 μm or less, a thermosetting resin and organic fibers.

JP-A 62-45446 and JP-A 62-156044 disclose materials for shell molds containing sand coated with a thermosetting resin and hydrated magnesium silicate clay mineral.

GB-A 1281684 (JP-B 50-20545) discloses a heat insulating body used for casting molten metal and describes a gas permeability thereof.

SUMMARY OF THE INVENTION

The present invention relates to a structure for producing cast articles containing one or more inorganic particles (referred to as "inorganic particle A" hereinafter) selected from amorphous and artificial graphites, an inorganic fiber and a thermosetting resin and having a gas permeability of 1 to 500.

The present invention also relates to a composition for a structure for producing cast articles, containing one or more inorganic particles selected from amorphous and artificial graphites, an inorganic fiber and a thermosetting resin, in which the structure has a gas permeability of 1 to 500.

The present invention also relates to a method for producing a structure for producing cast articles, including: dispersing the composition for the structure for producing cast articles of the present invention in a dispersing medium to prepare a mold material in a dough state; filling a forming mold with the mold material; and heating the forming mold to cure the thermosetting resin to form the structure.

The present invention also relates to a method for producing a cast article, including: casting a molten metal with the structure for producing cast articles of the present invention.

The present invention also relates to use of the structure for producing cast articles for producing a cast article.

DETAILED DESCRIPTION OF THE INVENTION

Figure 1:
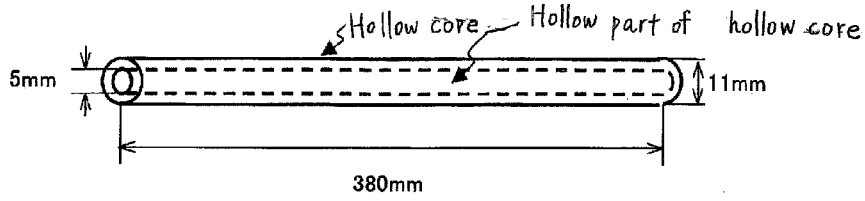
FIG. 1 shows a schematic perspective view of a structure for producing cast articles produced in Experiments.

The structure described in JP-A2005-349428 has good hot strength in casting and well retains a shape of a cast product, and thus can produce a cast article having good surface smoothness. However, it has a weakness that a cast article of a complicated shape produced therewith is subject to gas defect. Therefore, there is a need for reduction of gas defect of cast articles.

The present invention provides a structure for producing cast articles, which is lightweight, has sufficient hot strength in casting, and achieves an effect of reducing gas defect in production of cast articles, a method for producing the same, a composition for the same, and a method for producing a cast article with the same.

According to the present invention, there is provided a structure for producing cast articles having sufficient hot strength in casting and achieving an effect of reducing gas defect in production of cast articles. The structure of the present invention is a structure for producing cast articles such as a mold, which is lightweight, has good processability, and is used in producing cast articles.

The present invention provides a structure for producing cast articles, which is lightweight, has sufficient hot strength in casting, well retains a shape of a cast product, and achieves an effect of reducing gas defect in production of cast articles particularly under strict conditions for producing a cast article of a complicated shape.

The present invention is a structure for producing cast articles such as a mold, which is lightweight, has good processability, and is used in producing cast articles.

The structure for producing cast articles of the present invention contains one or more inorganic particles selected from amorphous and artificial graphites, inorganic fibers and a thermosetting resin, is characterized by having a gas permeability of 1 to 500, has sufficient hot strength in casting, and achieves a good effect of decreasing gas defect in production of a cast article having a complicated shape.

We have intensively studied to reduce gas defect in production of cast articles particularly under strict conditions such as for producing a cast article of a complicated shape in the field of casting with a structure of lightweight having good processability, and have found that a structure for producing cast articles having a gas permeability of 1 to 500 can significantly reduce gas defect in production of cast articles particularly under strict conditions for producing a cast article of a complicated shape.

That is, the present invention is characterized in technical terms by the finding that particularly when producing a cast article having a particularly complicated shape with a structure for producing cast articles of lightweight having good processability, the structure having a gas permeability in a specific range can be an effective means for solving the problem of generation of gas defect of the cast article.

To meet a specified range of a gas permeability of the structure, it is necessary to select one or more inorganic particles selected from amorphous and artificial graphites (inorganic particle A), preferably to select inorganic particle A having the average particle diameter of 80 μm to 3000 μm and shape factor of 2.3 to 1.0, as described below.

From the viewpoint of good effect of reducing gas defect of a cast article, a gas permeability of the structure for producing cast articles of the present invention is not less than 1, preferably not less than 2, more preferably not less than 3, even more preferably not less than 6, and still even more preferably 15. From the viewpoints of good effect of reducing gas defect of a cast article and sufficient hot strength in casting, the gas permeability of the structure for producing cast articles of the present invention is not more than 500, preferably not more than 400, more preferably not more than 300, even more preferably not more than 120, and still even more preferably not more than 100. From these viewpoints, the gas permeability of the structure for producing cast articles of the present invention is 1 to 500, preferably 2 to 500, more preferably 6 to 120, and even more preferably 15 to 100. The gas permeability of a structure for producing cast articles can be determined according to the method of measurement described in Experiments.

Further, from the viewpoint of ensuring the gas permeability of the structure for producing cast articles, we have found that a shape factor of the one or more inorganic particles selected from amorphous and artificial graphites, preferably inorganic particle A, is preferably in the range from 2.3 to 1.0 to ensure the gas permeability in the range of 1 to 500. The structure for producing cast articles containing the one or more inorganic particles can produce a cast article in high quality. From the viewpoint of good effect of reducing gas defect of a cast article, a shape factor of the one or more inorganic particles selected from amorphous and artificial graphites used in the present invention is preferably 2.3 to 1.0, and more preferably 2.1 to 1.0.

A shape factor of inorganic particle such as inorganic particle A, is defined as described below.

<Method for Measuring a Shape Factor of Inorganic Particles>

For measuring a shape factor of the inorganic particles, used is a method of measuring a shape factor described in "Imonosa Ryuukei to Igata Tokusei (particle shape of molding sand and characteristics of mold)," study and research report, December, 2003, p 10-15, Japan Foundry Society, Inc. In the method, a measurement apparatus used is VH-5000 manufactured by Keyence Corporation, an image analysis software is VHX-H2M manufactured by Keyence Corporation. A microscopic image of inorganic particles is taken at 50-fold, and subjected to image analysis to determine a boundary length and an area. A boundary length and an area of each inorganic particle are assigned to variables in the following calculation formula of shape factor to calculate a shape factor of the inorganic particle. In taking a microscopic image, inorganic particles are monodispersed on white paper, and there are five or more inorganic particles in a field. One sample is randomly measured and calculated for shape factor twenty times. An average value thereof is used as a shape factor of the inorganic particles.

$$\text{shape factor}=(\text{boundary length})^2/(4\pi\times\text{area})$$

The present invention exhibits a significant effect of reducing gas defect generated particularly under strict conditions for producing a cast article of a complicated shape.

The mechanism to exhibit such effect is not known exactly, but is thought as follows. In the field of casting with a structure of lightweight having good processability, conventional structures for producing cast articles do not have sufficient gas permeability, and a trace amount of gas generated from the structure for producing cast articles enters in molten metal constructing a cast article particularly under strict conditions for casting an article of complicated shape. Gas defect is accordingly generated on the surface of the cast article. In contrast, the structure for producing cast articles of the present invention has an appropriate gas permeability and significantly prevents a trace amount of gas generated from the structure for producing cast articles from entering molten metal constructing a cast article particularly under strict conditions for casting an article of complicated shape. Gas defect of the cast article is accordingly particularly reduced.

Further, the one or more inorganic particles selected from amorphous and artificial graphites having a shape factor in the range of preferably 2.3 to 1.0 and more preferably 2.1 to 1.0 ensure voids constructing a matrix of the structure for producing cast articles to achieve the gas permeability of 1 to 500, resulting in a cast article having improved quality.

The structure for producing cast articles having a specific gas permeability of the present invention, as described below, can be prepared by selecting a kind, a particle diameter and an aspect ratio of the inorganic particles, a kind of the thermosetting resin, and a blend ratio thereof, and the like to be obtained.

A blend ratio (mass ratio) of inorganic particle A, the inorganic fibers and the thermosetting resin in the structure for producing cast articles of the present invention is preferably inorganic particle A/inorganic fibers/thermosetting resin=40 to 90/1 to 20/1 to 30 (mass ratio), more preferably, 50 to 85/2 to 16/2 to 25 (mass ratio), and even more preferably 50 to 85/2 to 16/2 to 20 (mass ratio).

The inorganic particle is an ingredient for enhancing heat resistance of the structure. In the present invention, from the viewpoints of improved gas permeability of the structure for producing cast articles and burning resistance, at least one (inorganic particle A) graphite selected from amorphous and artificial graphites is used. Further, from the viewpoints of stable quality and easy control of gas permeability of the structure, artificial graphite is preferably used.

Other inorganic particles than amorphous and artificial graphites such as obsidian, mica, mullite, silica, magnesia and talc may be simultaneously used as an arbitrary ingredient within the range that can achieve the effect of the present invention. These inorganic particles may be used alone or in combination of two or more.

In general, graphite is classified into natural products such as flake graphite and amorphous graphite and artificial graphite produced form such as petroleum coke, carbon black, and pitch. Flake graphite is characterized by having a flaky shape and easily accumulating in a stratal manner.

A percentage of a sum of inorganic particle A in the total inorganic particles is preferably not less than 90% by weight, more preferably not less than 95% by weight, and even more preferably 100% by weight in substance.

From the viewpoint of improved gas permeability of the structure for producing cast articles, an average particle diameter of inorganic particle A is preferably not less than 80 μm, more preferably not less than 100 μm, and even more preferably not less than 120 μm. From the viewpoint of sufficient hot strength of the structure for producing cast articles in casting, the average particle diameter of inorganic particle A is preferably not more than 3000 μm, more preferably not more than 2500 μm, even more preferably not more than 1000 μm, and still even more preferably not more than 800 μm. From these viewpoints, the average particle diameter of inorganic particle A is preferably 80 to 3000 μm, more preferably 100 to 2500 μm, even more preferably 100 to 1000 μm, and still even more preferably 120 to 800 μm.

In the present invention, an average particle diameter of the inorganic particles such as inorganic particle A can be measured according to the following methods. The inorganic particles are firstly subjected to a first method of measurement. If a resultant value is 200 μm or more, the value is used as an average particle diameter, and if not, the inorganic particles are again measured by a second method of measurement.

<First Method of Measurement>

Inorganic particles are measured according to the method specified in Appendix 2 of JIS 22601 (1993) "test method for molding sand," and a diameter at which a mass accumulation is 50% is set to an average particle diameter. The mass accumulation is to be calculated as considering that particles remaining on respective sieves have corresponding "average diameters Dn (μm)" described in Practical Table 2 of JIS Z2601 (1993).

<Second Method of Measurement>

Inorganic particles are measured with a laser diffraction particle size distribution measurement apparatus (LA-920 manufactured by Horiba Ltd.), and a diameter at which a mass accumulation is 50% is set to an average particle diameter.

Analysis conditions are as follows.

measurement method: flow method refractive index: variable according to inorganic particles (see, a manual for LA-920)

dispersing medium: methanol dispersing method: ultrasonic agitation for three minutes, with a built-in unit sample concentration: 2 mg/100 cc From the viewpoints of good shape retention of the structure in casting and good surface properties and good releasing properties of a cast product after molding, a content of inorganic particle A is preferably 40 to 90% by mass and more preferably 50 to 85% by mass of the structure. A value of the content may be a value of the blend amount in production of the structure (similarly applicable to the followings).

The inorganic fibers mainly serve for forming a skeleton of the structure and maintain the shape thereof, for example, without burning when the structure is used in casting and heated with molten metal. Examples of the inorganic fiber include synthetic mineral fibers such as carbon fibers and rock wool, ceramic fibers, and natural mineral fibers. As the inorganic fibers, these may be used alone or in combination of two or more. Among them, from the point of effective prevention of contraction combined with carbonization of the thermosetting resin, preferred are carbon fibers having high strength at high temperature, more preferred are pitch-based and polyacrylonitrile (PAN)-based carbon fibers, and even more preferred are polyacrylonitrile (PAN)-based carbon fibers.

From the viewpoints of formability and uniformity of the structure such as a mold, the inorganic fibers have an average fiber length of 0.5 to 15 mm, and more preferably 1 to 8 mm.

From the viewpoints of formability and shape retention in casting of the structure, a content of the inorganic fibers is preferably 1 to 20% by mass, and more preferably 2 to 16% by mass of the structure.

The thermosetting resin is an essential ingredient for maintaining cold strength (strength at room temperature) and hot strength (strength at high temperature) of the structure, providing good surface properties to the structure and improving a surface roughness of a cast article produced with the structure used as a casting mold. Examples of the thermosetting resin include phenolic, epoxy and furan resins. Among them, particularly from the points of a small amount of gas derived form thermosetting resin in casting, an effect of suppressing combustion, high residual carbon ratio after pyrolysis (carbonization) of 25% or more, and formation of a carbonized film to produce a good cast surface when the structure is used as a casting mold, phenolic resins are preferably used. Phenolic resins include novolac phenolic resins requiring a curing agent and resol phenolic resins not requiring a curing agent. These thermosetting resins may be used alone or in combination of two or more.

Among phenolic resins, resol phenolic resins are more preferably used alone or in combination, because these do not require a curing agent such as an acid and an amine, and can reduce odor in forming the structure and reduce cast defect when the structure is used as a casting mold.

Examples of a commercially available resol phenolic resin include trade name KL-4000 manufactured by Asahi Organic Chemicals Industry Co., Ltd. and Bellpearl S-890 manufactured by Air Water Inc.

From the viewpoints of moldability and shape retention in casting of the structure and surface smoothness of a cast article, a content of the thermosetting resin is preferably 1 to 30% by mass, more preferably 2 to 25% by mass, and even more preferably 2 to 20% by mass of the structure.

In the present invention, from the viewpoint of improvement of moldability of the structure for producing cast articles, the mold material for the structure for producing cast articles preferably further is added a water-soluble polymer compound as a raw material.

The water-soluble polymer compound used in the present invention refers a polymer compound adsorbing or absorbing water under general conditions of use (e.g., 25° C.). For example, a water-soluble polymer compound dissolving in pure water in an amount of 1.0% by mass or more at 25° C. is preferred.

Examples of the water-soluble polymer compound used in the present invention include polysaccharides as a thickening agent, polyvinyl alcohols and polyethylene glycols.

Among them, from the viewpoint of improvement of moldability, polysaccharides as a thickening agent are preferred. As used herein, the polysaccharide as a thickening agent refers a polysaccharide exhibiting properties as a thickening agent in an aqueous system. Examples of the polysaccharide as a thickening agent include gum agents such as xanthan gum, tamarind gum, gellant gum, guar gum, locust bean gum and tara gum; cellulose derivatives such as carboxymethyl cellulose and hydroxyethyl cellulose; carrageenan; pullulan; pectin; alginic acid; and agar. Among these polysaccharides, from the point of achievement of performance of the water-soluble polymer compound with smaller blend ratio in the composition for the structure for producing cast articles, artificial products such as cellulose derivatives including carboxymethyl cellulose is more preferred than natural products such as agar.

A weight average molecular weight of the water-soluble polymer compound is preferably 10000 to 3000000, and more preferably 20000 to 1000000.

When the water-soluble polymer compound is contained in the structure for producing cast articles, from the viewpoint of improvement of moldability of the structure, a content of the water-soluble polymer compound is preferably not less than 0.5% by mass, and more preferably not less than 1% by mass. From the viewpoint of imparting gas permeability to the structure, the content is preferably not more than 10% by mass, more preferably not more than 5% by mass, and even more preferably not more than 3% by mass. From these viewpoints, the content of the water-soluble polymer compound is preferably 0.5 to 10% by mass, and more preferably 1 to 5% by mass of the structure.

In the present invention, from the viewpoint of improvement of moldability of the structure for producing cast articles, the mold material for the structure for producing cast articles preferably is further added heat-expandable particles as a raw material.

The heat-expandable particle used in the present invention is preferably a microcapsule having a shell wall of thermoplastic resin and including an expanding agent that expands by vaporization. The microcapsule preferably expands to 3 to 5 times its diameter and to 50 to 100 times its volume, for example, when heated at 80 to 200° C. An average particle diameter before expanding is preferably 5 to 80 μm, and more preferably 20 to 50 μm. The heat-expandable particles having an expanding range as described above can highly achieve its effect due to addition with preventing an adverse effect on accuracy of molding due to expanding.

Examples of the thermoplastic resin constructing the shell wall of the microcapsule include polystyrenes, polyethylenes, polypropylenes, polyacrylonitriles, polyvinylidene chlorides, acrylonitrile-vinylidene chloride copolymers, ethylene-vinyl acetate copolymers and a combination thereof. Examples of the expanding agent included in the shell wall include organic solvents having low boiling points such as propane, butane, pentane, hexane, isobutane and petroleum ether. Among them, from the viewpoints of appropriate temperature of expansion start and high expanding rate, the shell wall is preferably constructed with a polymer of acrylonitrile or vinylidene chloride or a copolymer containing one or more of them.

When the structure for producing cast articles is added the heat-expandable particles, from the viewpoint of good moldability of the structure, a content of the heat-expandable particles is preferably 0.5 to 10% by mass, and more preferably 1 to 5% by mass of the structure.

The mold material for the structure for producing cast articles containing 0.5% by mass or more of heat-expandable particle expands and fills a mold into every hole and corner to form a precise shape of the mold, which situation is preferable from the viewpoint of sufficient achievement of the effect due to addition. The mold material containing 10% by mass or less, excess expansion can be prevented and extra time for cooling is not required, which situation is preferable from the viewpoint of maintenance of high productivity.

The heat-expandable particle will be described in detail below.

As described below, in the present invention, the structure for producing cast articles is preferably prepared by dispersing the composition for the structure for producing cast articles into a dispersing medium, kneading with a kneader to produce a mold material in a dough state, and forming the mold material into the structure. The heat-expandable particle is preferably added (preferably in a dry manner) to the composition. At this time, in the present invention, the heat-expandable particle added may have an expansion start temperature (° C.) equal to or lower than a boiling point (° C.) of the dispersing medium. The structure for producing cast articles is accordingly formed accurately and a high gas permeability is obtained. A gas defect is largely reduced in a cast article. Further, from the viewpoints of moldability of the structure for producing cast articles into a complicated shape and largely reduced gas defect of a cast article due to high gas permeability, the heat-expandable particle has an expansion start temperature (° C.) preferably 5 to 100° C. lower, more preferably 10 to 80° C. lower, and even more preferably 10 to 70° C. lower than a boiling point of the dispersing medium.

An expansion start temperature (° C.) of the heat-expandable particles is a temperature of starting volume change described in JP-A11-2615 (see, e.g., Paragraph 0012 in JP-A11-2615), and in the present invention, refers a temperature of starting volume change in rising a temperature under a condition of rising rate 10° C./min.

When a temperature of starting volume change of the heat-expandable particle varies, a minimum value of the temperature is considered as an expansion start temperature of the heat-expandable particle.

When a boiling point (° C.) of the dispersing medium is equal to or higher than a expansion start temperature (° C.) of the heat-expandable particles, examples of the thermoplastic resin used include acrylonitrile copolymers, vinylidene chloride-acrylonitrile copolymers, polypropylene, propylene-ethylene copolymers, propylene-butene copolymers, polyethylene, ethylene-vinyl acetate copolymers, ethylene-acrylate copolymers, ethylene-acrylic acid copolymers, polystyrene resins, acrylonitrile-styrene copolymers (AS resins), acrylonitrile-conjugated diene-styrene copolymers (ABS resins), methacrylate-styrene copolymers (MS resins), methacrylate-conjugated diene-styrene copolymers (MBS resins), styrene-maleic anhydride copolymers (SMA resins), styrene-conjugated diene copolymers and hydrogenated resins thereof (SBS, SIS, SEBS, SEPS, styrene elastomers), polyamide resins (polyamides, polyamide elastomers), polyester resins (polyesters, polyester elastomers), polyurethane resins, polyvinyl resins and polycarbonate resins. From the viewpoint of moldability for the structure for producing cast articles, the thermoplastic resin is preferably an acrylonitrile copolymer.

When a boiling point (° C.) of the dispersing medium is equal to or higher than a expansion start temperature (° C.) of the heat-expandable particle, examples of the hydrocarbon having low boiling point include isobutane, butane, pentane, isopentane, hexane, cyclohexane, heptane, petroleum ether, neopentane, propane, propylene, butene. From the viewpoint of effect of reducing gas defect of a cast article (improvement of gas permeability of the structure for producing a cast article), the compound having low boiling point is preferably a hydrocarbon compound having not more than six carbon atoms and a boiling point lower than 80° C. For the heat-expandable particle, these may be used alone or in combination of two or more.

When a boiling point (° C.) of the dispersing medium is equal to or higher than a expansion start temperature (° C.) of the heat-expandable particle, since the heat-expandable particle expands by heat and from the viewpoint of moldability, the heat-expandable particle preferably has an average particle diameter before expanding from 1 to 60 μm, more preferably 2 to 50 μm, and even more preferably 5 to 30 μm. The heat-expandable particle preferably expands to 3 to 10 times its diameter by heating at 80 to 200° C.

From the viewpoint of forming a structure for producing cast articles having a complicated shape and being a precise copy of a mold in detail, a content of the heat-expandable particles in the slurry composition according to the present invention is preferably not less than 0.1% by mass, and more preferably not less than 0.5% by mass of the total mass of solid raw materials of the slurry composition. From the viewpoint of good effect of reducing gas defect of a cast article, the content of the heat-expandable particles is preferably not more than 15% by mass, more preferably not more than 10% by mass, and even more preferably not more than 5% by mass of the total mass of solid raw materials of the slurry composition. From these viewpoints, the content of the heat-expandable particles is preferably 0.1 to 15% by mass, more preferably 0.5 to 10% by mass, and even more preferably 0.5 to 5% by mass of the total mass of solid raw materials of the slurry composition.

Other ingredients, such as a colorant, a releasing agent, colloidal silica, than those described above can be added to the starting mold material for the structure for producing cast articles of the invention in an appropriate amount, or during or after molding.

When the structure of the invention is produced from a mold material containing water, a moisture content by mass in the structure before used (subjected to casting) is preferably not more than 5%, and more preferably not more than 2%. The lower moisture content results in the smaller gas generation derived from moisture vapor in casting, and thus more reduced gas defect.

The structure for producing cast articles obtained by the present invention is applicable to a main mold having a cavity of a cast product shape inside the hollow core, a core used in the main mold, a member for a pouring system such as a runner, a filter holding tool, and the like. Since the structure for producing cast articles of the present invention has good surface smoothness and can produce a cast article having good cast surface, it is preferably applied for a main mold and a core. Since the structure for producing cast articles of the present invention is excellent in effect of reducing gas defect of a cast article, it is particularly preferably applied for a core that is covered with molten metal in casting and more likely generates gas defect, and more preferably for a hollow core.

<Method for Producing a Structure for Producing Cast Articles>

Next, a method for producing the structure for producing cast articles of the present invention will be described with reference to a preferred embodiment.

The method for producing the structure for producing cast articles of the present invention preferably contains: preparing a mold material containing one or more inorganic particles selected from amorphous and artificial graphites, inorganic fibers, a thermosetting resin and a dispersing medium (a composition containing the composition for the structure for producing cast articles and a dispersion medium); and injecting the mold material into a forming mold to produce the structure for producing cast articles.

The composition for the structure for producing cast articles used in the present invention contains one or more inorganic particles selected from amorphous and artificial graphites, inorganic fibers and a thermosetting resin, provides the structure for producing cast articles having a gas permeability of the structure for producing cast articles of 1 to 500, and is preferably dispersed in a dispersing medium to be used. From the viewpoint of preventing separation of mold materials for the structure for producing cast articles (inorganic particle A, inorganic fibers, thermosetting resin) and the dispersing medium and uniformly mixing them, the composition for the structure for producing cast articles preferably further contains a water-soluble polymer compound. That is, this composition for the structure for producing cast articles is used for producing the structure for producing cast articles having a gas permeability of 1 to 500.

It would appear that the water-soluble polymer compound added to the composition for the structure for producing cast articles forms a matrix of polymer chain in the mold material and thereby prevents separation of the mold material from the dispersion medium. It would also appear that the water-soluble polymer compound prevents aggregation of the mold material and ensures flowability of the composition, and thereby contributes to improvement of moldability of the structure.

A blend ratio (mass ratio) of ingredients of the preferred composition for the structure for producing cast articles used in the present invention is preferably inorganic particle A/inorganic fibers/thermosetting resin/water-soluble polymer compound (solid content)=40 to 90/1 to 20/1 to 30/1 to 10 (mass ratio), more preferably 50 to 85/2 to 16/2 to 25/1 to 7 (mass ratio), and even more preferably 50 to 85/2 to 16/2 to 20/1 to 7 (mass ratio), with respect to the total mass of solid contents of inorganic particle A, the inorganic fibers, the thermosetting resin, and the water-soluble polymer compound (wherein, the total of the mass ratio is 100). Further, in the composition for the structure for producing cast articles, either of the followings is preferably 90 to 100% by mass, and more preferably 95 to 100% by mass: (i) a total content of inorganic particle A, the inorganic fibers and the thermosetting resin; (ii) a total content of inorganic particle A, the inorganic fibers, the thermosetting resin and the water-soluble polymer compound; (iii) a total content of inorganic particle A, the inorganic fibers, the thermosetting resin and the heat-expandable particles; and (iv) a total content of inorganic particle A, the inorganic fibers, the thermosetting resin, the water-soluble polymer compound and the heat-expandable particles. In the composition for the structure for producing cast articles, a content of organic fibers can be decreased to not more than 0.1% by mass, further decreased to not more than 0.05% by mass. Addition of the organic fibers can improve strength of the structure itself, but also can increase probability of generation of pyrolysis gas from the organic fibers to induce gas defect.

The composition containing inorganic particle A in the range described above will provide a structure that well retains a shape in casting, has good surface properties, and has preferable releasing properties after molding. The composition containing the inorganic fiber in the range described above will have a good moldability and provide a structure that well retains a shape after molding. The composition containing the thermosetting resin in the range described above will have good moldability and provide a casting mold that well retains a shape in casting and has good surface smoothness. The composition containing the water-soluble polymer compound in the range described above will be filled in a forming mold in a state of good flowability without separation of the dispersing medium from the mold material (raw material prepared by adding the dispersing medium to the composition for producing the structure) and provide a structure having good gas permeability.

The composition for the structure for producing cast articles is preferably prepared by dry mixing inorganic particle A, the inorganic fibers and the thermosetting resin. From the viewpoints of uniform mixing and improving moldability, the composition for the structure for producing cast articles is preferably prepared by further dry mixing the water-soluble polymer compound in advance. From the viewpoint of moldability, the composition for the structure for producing cast articles is preferably prepared by further dry mixing the heat-expandable particles in advance. A mixture thereof is then preferably dispersed in the dispersing medium and kneaded with a kneader to prepare the composition for the structure for producing cast articles in a dough state. The mold material in a dough state is preferably filled in a forming mold, the forming mold is heated to cure the thermosetting resin, and thereby forming the structure.

The dispersing medium is an aqueous dispersing medium, including solvents such as water, ethanol and methanol and mixed solvents thereof. From the points of stability, cost, usability, and the like of the structure, water is particularly preferred.

As used herein, preparation of the mold material in a dough state from the composition for the structure for producing cast articles refers that a composition containing inorganic particle A, the inorganic fibers and the thermosetting resin and the dispersing medium are mixed and kneaded to produce the mold material having flowability in a state that inorganic particle A and the inorganic fivers are hard to separate from the dispersing medium.

From the viewpoint of preparation of the mold material having flowability in a state that inorganic particle A and the inorganic fivers are hard to separate from the dispersing medium, a content of the dispersing medium in the mold material is preferably 10 to 100% (by mass), more preferably 25 to 80% (by mass), and even more preferably 30 to 70% (by mass) to the total mass of solid contents of inorganic particle A, the inorganic fibers, the thermosetting resin and the water-soluble polymer compound.

Next, the forming mold used in the method for producing the structure for producing cast articles of the present invention is constructed, for example, with a main mold having a cavity corresponding to a hollow bar-like article shown in FIG. 1 and a core material to form a hollow part.

The forming mold is heated to approximately 120 to 250° C., considering volatilization of the dispersing medium, curing of the thermosetting resin and expansion of the heat-expandable particles.

Then the forming mold, which is attached with a means for opening/closing a gate, is filled with the composition for the structure for producing cast articles. A filling pressure is preferably approximately 0.5 to 3 MPa in the case of using air pressure.

The composition for the structure for producing cast articles filled in the forming mold is dried with releasing vapor derived from the dispersing medium and gas derived from the thermosetting resin, which are generated by heat of the forming mold, cooled, and subjected to treatments such as trimming and application of agents if required. The structure for producing cast articles of the present invention thus can be produced.

<Method for Producing a Cast Article>

Next, a method for producing a cast article with the structure for producing cast articles of the present invention will be described with reference to a preferred embodiment thereof. In the method for producing a cast article of the invention, the structure for producing cast articles thus obtained is buried in molding sand at a predetermined position to form a mold. Any sand conventionally used for producing a cast article of this type can be used as the molding sand with no specific limitation.

A molten metal is poured into the mold through a molten metal inlet to be cast. In casting, the structure of the present invention maintains hot strength and, not being so contracted with pyrolysis of the structure, cracks and breakages of the structure itself for producing cast articles can be prevented to reduce probability of penetration of the molten metal into the structure, and sticking of the molding sand to the structure.

After casting is finished, a cast metal is cooled to a predetermined temperature. A flask is released to remove the molding sand. The structure for producing cast articles is removed by blasting to expose a cast article. In this time, since the thermosetting rein has been pyrolytically decomposed, the structure for producing cast articles is easy to be removed by the treatment. The cast article is then subjected to after-treatments such as trimming according to need to complete the production of a cast article.

A more preferred method for producing a cast article is an aspect of using the structure for producing cast articles of the present invention as a hollow core. For example, a method includes placing the hollow core in a casting mold such that at least one opening of the hollow core is opened outside the casting mold, and pouring a molten metal into the casting mold.

Figure 3:
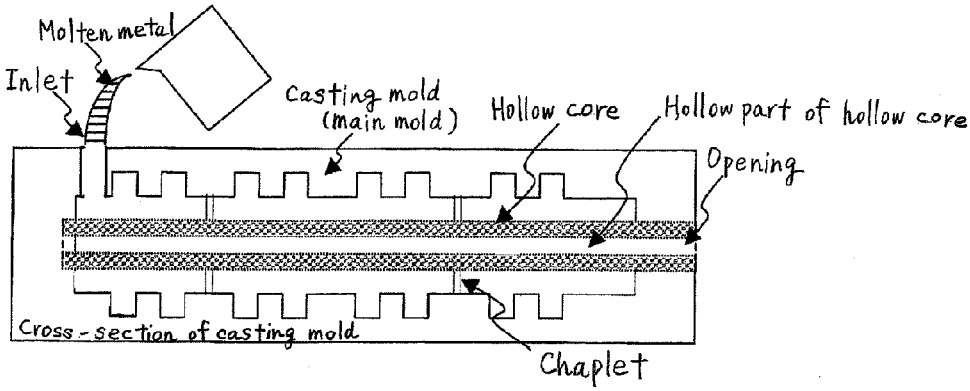
FIG. 3 shows a schematic drawing of a casting mold used in Experiments.
Figure 4:
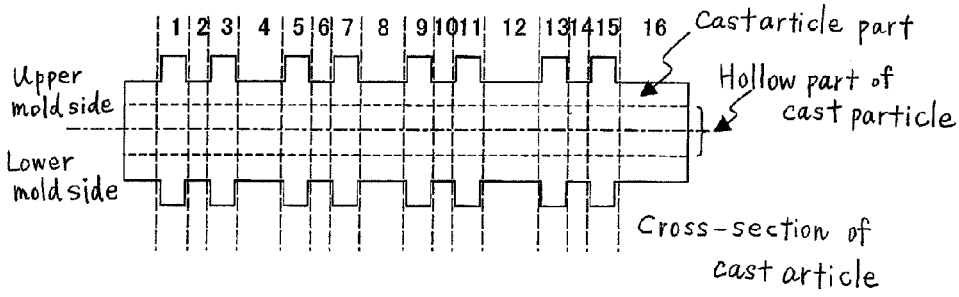
FIG. 4 shows a schematic drawing of a cast article divided into sixteen sections along with axe directions for evaluating defect on the surface of the cast article.

In particular, the method includes placing a hollow core shown in FIG. 1 in a main mold, holding the hollow core with a chaplet such that at least one opening of the hollow core is opened outside the casting mold, and pouring a molten metal into the casting mold to produce a cast article, as shown in FIG. 3.

A method of placing the hollow core such that at least one opening of the hollow core is opened outside the casting mold may be a method of providing an opening to the main mold such that the opening communicates with a hollow part of the hollow core.

EXPERIMENT

The following Experiments are intended to illustrate and compare the present invention and not to limit the present invention.

Experiment 1 to 7

<Preparation of Compositions for the Structure for Producing Cast Articles and Mold Materials>

Figure 5:
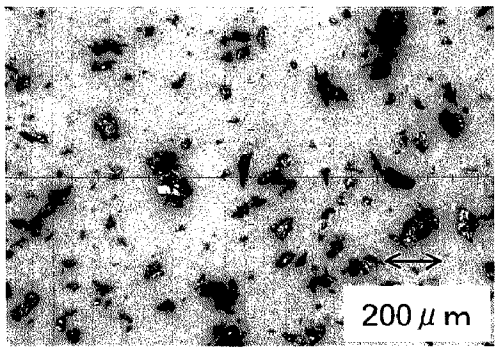
FIGS. 5, 6 and 7 show microscopic photo pictures of graphites measured for the shape factor and photo pictures treated to obtain analyzed images.
Figure 5:
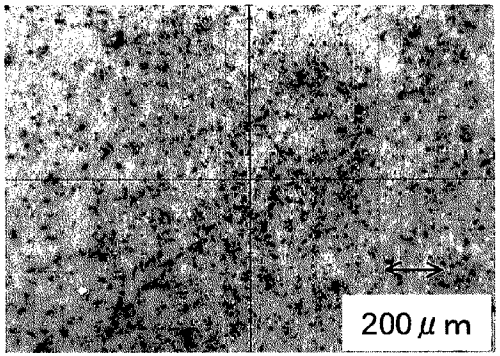
Figure 5:
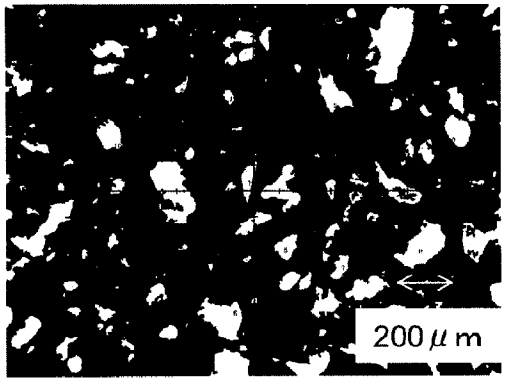
Figure 5:
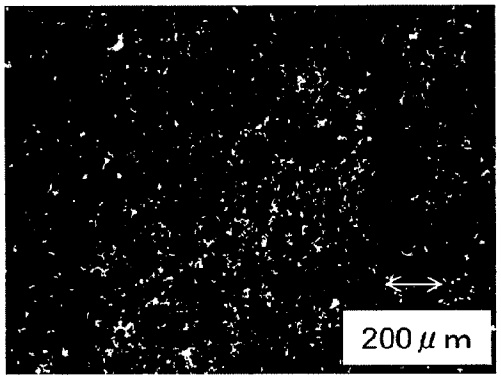
Figure 6:
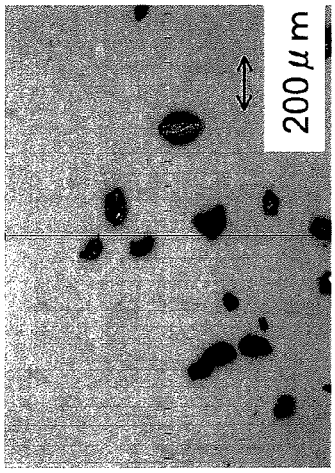
Figure 6:
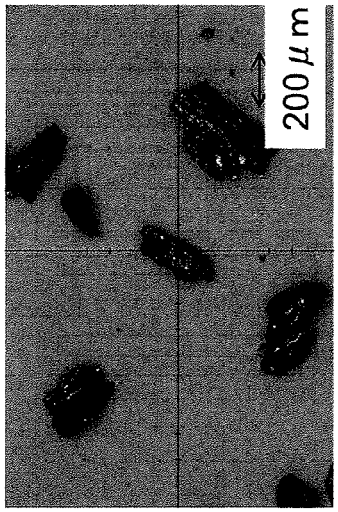
Figure 6:
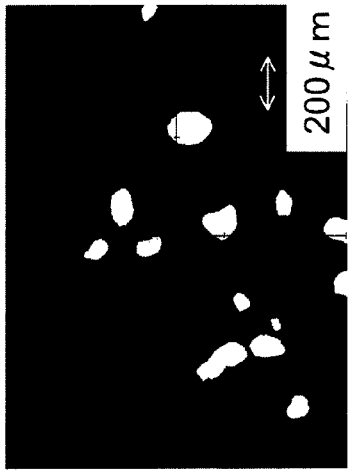
Figure 6:
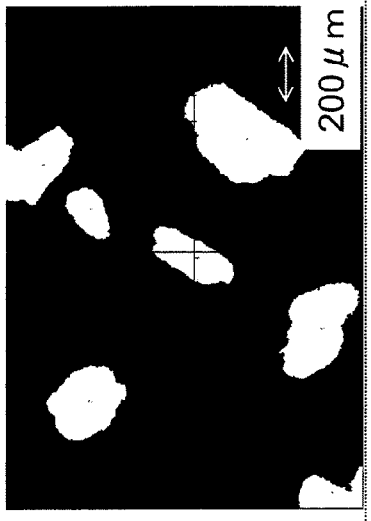
Figure 7:
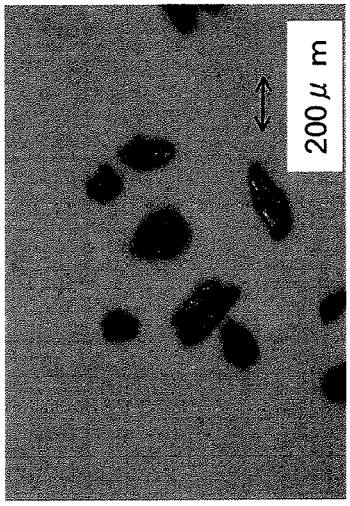
Figure 7:
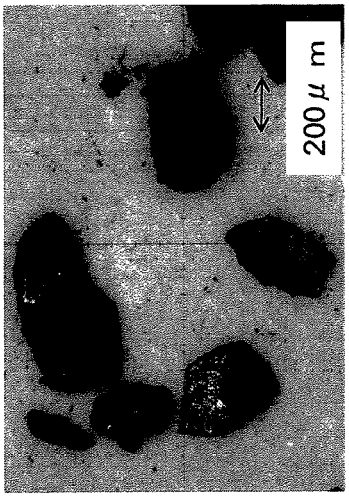
Figure 7:
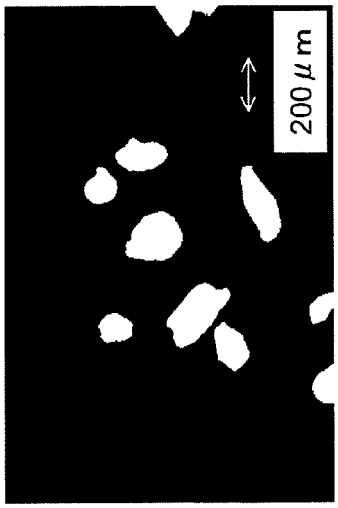
Figure 7:
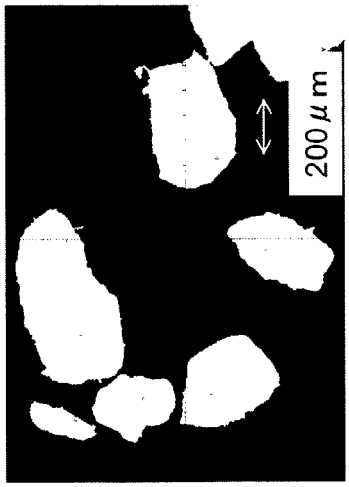

Inorganic particles, inorganic fibers, thermosetting resins, water-soluble polymer compounds and heat-expandable particles were used in such combinations and ratios (mass ratios) as shown in Table 1 to prepare compositions for the structure for producing cast articles. To these compositions for structure for producing cast articles was added water to prepare mold materials in a dough state each containing approximately 40% of water (in the total of a composition for the structure for producing cast articles and water, water accounted for 40% by mass). Ingredients shown in Table 1 were as follows. A shape factor of inorganic particles was measured by the method described above. FIGS. 5 to 7 show microscopic photos (microscopic images) and analyzed images, obtained by treating the photos, of a part of inorganic particles for measurement of shape factor. Each of FIGS. 5 to 7 shows a result in twenty random measurements.

[Inorganic Particles]

Flake graphite 1: "BP8083" manufactured by Bogala Graphite Lanka Limited, average particle diameter: 56 μm Flake graphite 2: "#285" manufactured by Qingdao Yanxin Graphite Products Co., Ltd., average particle diameter: 29 μm Artificial graphite 1: "KIRIKO (cut powder) F" manufactured by Nippon Graphite Industries, ltd., average particle diameter: 150 μm Artificial graphite 2: "AGB-604" manufactured by Ito Kokuen Co., Ltd., average particle diameter: 210 μm Artificial graphite 3: "G-30" manufactured by Nippon Graphite Industries, ltd., average particle diameter: 101 μm Amorphous graphite 1: "AE-1" manufactured by Chuetsu Graphite Works Co., Ltd., average particle diameter: 425 μm.

Amorphous graphite 2: "amorphous graphite" manufactured by Teikenkako Co., Ltd., average particle diameter: 30 μm FIG. 5 shows microscopic photos and analyzed images of flake graphites 1 and 2 that were measured for shape factor. FIG. 6 shows microscopic photos and analyzed images of artificial graphites 1 and 2 that were measured for shape factor, respectively. FIG. 7 shows microscopic photos and analyzed images of artificial graphite 3 and amorphous graphite 1 that were measured for shape factor, respectively.

[Inorganic Fibers]

Carbon fiber: PAN carbon fiber (trade name "Pyrofil chopped fiber" manufactured by Mtsubishi Rayon Co., Ltd., fiber length: 3 mm)

[Thermosetting Resin]

Phenolic resin: "KL-4000" manufactured by Asahi Organic Chemicals Industry Co., Ltd.

[Water-Soluble Polymer Compound]

CMC: carboxymethyl cellulose sodium (Celogen WS-C manufactured by Dai-Ichi Kogyo Seiyaku Co., Ltd.)

[Heat-Expandable Particles]

F-105D: trade name "Matsumoto Microsphere F-105D" manufactured by Matsumoto Yushi-Seiyaku Co., Ltd. (heat expansion starting point: 130° C.)

<Production of a Structure for Producing Cast Articles>

A forming mold used contained a main mold having a cavity corresponding to a hollow bar-like article as shown in FIG. 1 and a core material to form a hollow. The mold material prepared as above was filled in the heated forming mold at an air pressure 1 MPa. A temperature of the forming mold was 200° C. The filled material was dried by heat of the forming mold with releasing vapor derived from a dispersing medium and gas derived from a thermosetting resin out of the forming mold to produce a hollow bar-like article (a structure for producing cast articles) having an outer diameter 11 mm (a hollow diameter 5 mm) and a length 380 mm as shown in FIG. 1.

<Method for Measuring a Gas Permeability of a Molded Article>

Figure 2:
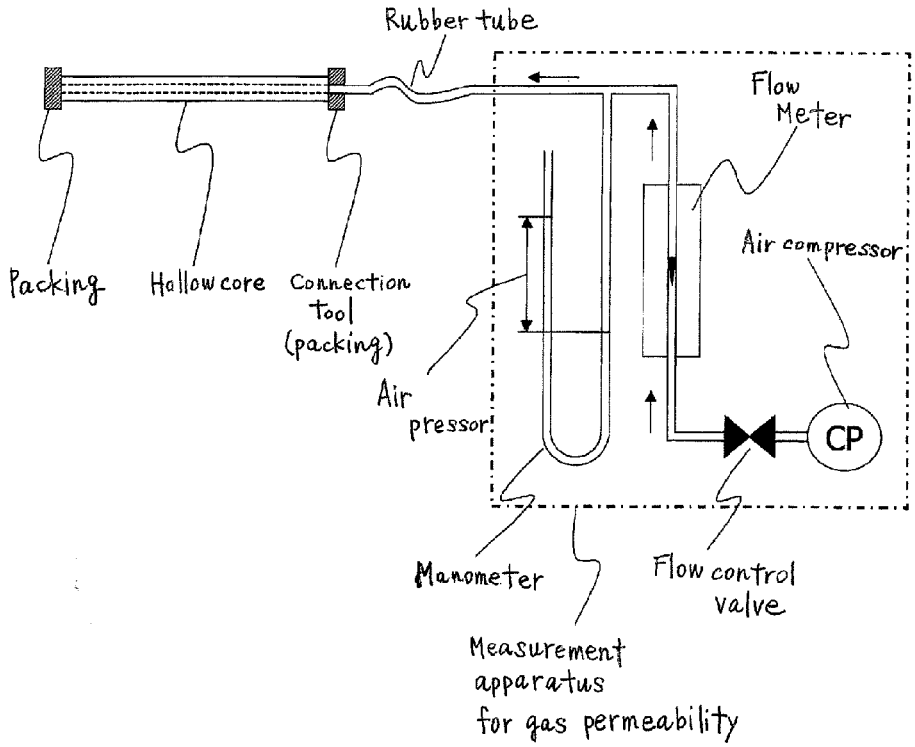
FIG. 2 shows a system of measuring a gas permeability of a structure used in Experiments.

A gas permeability was measured according to a method described in "Shoushitsu Mokei you Tokeizai no Hyoujun Shiken Houhou (standard test method for coating agent for lost pattern), Chapter 5: method for measuring a gas permeability", Japan Foundry Engineering Society, Kansai division, March, 1996, based on JIS 22601 (1993), "test method for molding sand", with an apparatus working by the same mechanism as of the apparatus for measuring a gas permeability (compressed air ventilating system) described in this publication (p. 24, FIG. 5-2). A gas permeability P is represented by the formula: $P=(h/(a\times p))\times v$, wherein h is a thickness of a sample (cm), a is a cross-sectional area ($cm^2$), p is a ventilation resistance ($cmH_2O$), and v is a flow rate of air ($cm^3$/min).

In the measurement, a thickness of a sample was a wall thickness of the molded article (hollow bar-like article), or "(outer diameter-hollow part diameter)/2". A cross-sectional area of a sample was "hollow part diameter×π×length."

In the measurement, the apparatus for measuring a gas permeability was attached with a rubber tube and a connection tool (packing) to connect the hollow part of the molded article without leakage as shown in FIG. 2. The molded hollow bar-like article was connected with the connection tool with no space between at one end of the hollow part of the hollow bar-like structure, and blocked with a packing or the like at the other end, and subjected to the measurement.

<Casting an Cast Article>

The hollow core shown in FIG. 1 was set in a main mold as shown in FIG. 3. To a casting mold containing them was poured the following molten metal to produce a cast article having the following shape.

Molten metal: cast iron corresponding to JIS FC300, molten metal temperature: 1400° C.

Shape of a cast article: hollow bar-like, an outer diameter 54 mm, a length 280 mm and a hollow part diameter 11 mm.

Casting mold (main mold): shell mold split into the upper and the lower parts, horizontal dividing surfaces thereof pass through the center line of a cast article.

<Evaluation of a Cast Article>

Cast articles obtained above were evaluated for defects on the surface thereof by scoring. The scoring was performed as follows: a cast article was axially divided into sixteen areas; each of areas was evaluated for surfaces of the upper mold side and the lower mold side, and scored in terms of possible defects; and scores were counted for comparison. For each of defects (1) to (5) below, a score in an area was set to 1 when not present and 0 when presents. A perfect score is therefore 5 for an area and 5×16=80 for the whole cast article. Results are shown in Table 1.

<Surface of the Upper Mold Side>

(1) burnt defect of sand (2) pinhole defect (spherical shape of 1 mm or more)

(3) crater defect (shallow dent of 3 mm or more)<

<The Lower Mold Side>

(4) burnt defect of sand (5) pinhole defect (spherical shape of 1 mm or more)

TABLE 1

| | | Composition of structure (% by mass) | | | | | Gas | Score of | Shape factor |
|---|---|---|---|---|---|---|---|---|---|
| | | Inorganic particles | Inorganic fibers | thermosetting resin | Water-soluble polymer compound | Heat-expandable particles | permeability of structure | cast article (point) | of inorganic particles |
| Experiment | 1 | Flake graphite 1 (82) | carbon fiber (4) | Phenolic resin (10) | CMC (2) | F-105D (2) | 3.6 | 62 | 2.85 |
| | 2 | Artificial graphite 1 (82) | carbon fiber (4) | Phenolic resin (10) | CMC (2) | F-105D (2) | 10.5 | 68 | 1.99 |
| | 3 | Artificial graphite 2 (82) | carbon fiber (4) | Phenolic resin (10) | CMC (2) | F-105D (2) | 35.2 | 70 | 1.85 |

TABLE 1-continued

| | Composition of structure (% by mass) | | | | | Gas | Score of | Shape factor |
|---|---|---|---|---|---|---|---|---|
| | Inorganic particles | Inorganic fibers | thermosetting resin | Water-soluble polymer compound | Heat-expandable particles | permeability of structure | cast article (point) | of inorganic particles |
| 4 | amorphous praphite 1 (82) | carbon fiber (4) | Phenolic resin (10) | CMC (2) | F-105D (2) | 98.6 | 71 | 2.05 |
| 5 | Flake graphite 2 (82) | carbon fiber (4) | Phenolic resin (10) | CMC (2) | F-105D (2) | 0.02 | 40 | 2.75 |
| 6 | Artificial graphite 3 (73) | carbon fiber (12) | Phenolic resin (10) | CMC (3) | F-105D (2) | 275 | 75 | 1.78 |
| 7 | amorphous praphite2 (82) | carbon fiber (4) | Phenolic resin (10) | CMC (2) | F-105D (2) | 0.05 | 45 | — 1) |

1) Amorphous graphite having an average particle diameter less than 100 μm had strong cohesiveness and was unable to form a uniform dispersion, and could not be measured.

As shown in Table 1, hollow bar-like articles (structures for producing cast articles) of Experiment 2, 3, 4 and 6 had appropriate gas permeability and could produce a cast article in which defects (burnt defect of sand, pinhole defect, crater defect) derived from gas defect of the cast article were significantly reduced. In contrast, it is also shown that hollow bar-like articles (structures for producing cast articles) of Experiments 1, 5 and 7, which were Comparative Experiments, had insufficient gas permeability and could not produce a cast article in which generation of defects were sufficiently reduced.

Experiments 11 to 24

<Preparation of a Slurry Composition>

Inorganic particles, inorganic fibers, thermosetting resins, water-soluble polymer compounds and heat-expandable particles were mixed and stirred in such combinations and ratios (mass ratios) as shown in Table 2 to prepare 100 g each of sold materials for slurry compositions. Then to these solid materials of the slurry composition were added 140 g each of dispersing medium, stirred for 10 minutes at 2000 rpm at 20 to 40° C. to prepare slurry compositions each contains approximately 41.7% by mass of solid materials (in the slurry composition, 41.7% by mass of slid material of slurry composition) and 58.3% by mass of dispersing medium (in the slurry composition, 58.3% by mass of dispersing medium). Ingredients shown in Table 2 were as follows.

[Inorganic Particles]

Artificial graphite: "G-30" manufactured by Chuetsu Graphite Works Co., Ltd., average particle diameter: 210 μm Amorphous graphite: "AE-1" manufactured by Chuetsu Graphite Works Co., Ltd., average particle diameter: 425 μm

[Inorganic Fibers]

Carbon fiber: PAN carbon fiber (trade name "Pyrofil chopped fiber" manufactured by Mtsubishi Rayon Co., Ltd., average fiber length: 3 mm)

[Thermosetting Resin]

Phenolic resin: (Bellpearl S-890 manufactured by Air Water Inc.) resol type

[Water-Soluble Polymer Compound]

CMC: carboxymethyl cellulose sodium (Celogen MP-60 manufactured by Dai-Ichi Kogyo Seiyaku Co., Ltd., weight average molecular weight: 370000 to 400000, dissolving in an amount of 3 g or more in 100 g of water at 25° C.)

[Heat-Expandable Particles]

Heat-expandable particles 1: trade name "Matsumoto Microsphere F-36" manufactured by Matsumoto Yushi-Seiyaku Co., Ltd. (heat expansion starting point: 75° C.)

Heat-expandable particles 2: trade name "Matsumoto Microsphere F-105D" manufactured by Matsumoto Yushi-Seiyaku Co., Ltd. (heat expansion starting point: 130° C.)

[Dispersing Medium]

Water: tapped water boiling point: 100° C.

Xylene: Wako Pure Chemical Industries, Ltd., grade: reagent 1st grade, boiling point: 140° C.

Acetone: Wako Pure Chemical Industries, Ltd., grade: Wako 1st grade, boiling point: 56.5° C.

Dichloromethane: Wako Pure Chemical Industries, Ltd., grade: Wako 1st grade, boiling point: 40.2° C.

<Production of a Structure for Producing Cast Articles>

A forming mold used contained a main mold having a cavity corresponding to a hollow bar-like article as shown in FIG. 1 and a core material to form a hollow. A slurry composition prepared as above was filled in the heated forming mold at an air pressure 1 MPa. A temperature of the forming mold was 160° C. The filled composition was heated for five minutes to produce a hollow bar-like article (a structure for producing cast articles) having an outer diameter 11 mm (a hollow diameter 5 mm)×a length 380 mm as shown in FIG. 1.

A gas permeability of a structure (molded article) for producing cast articles was determined in the same way as Experiments 1 to 7.

A cast article was produced in the same way as Experiments 1 to 7.

<Evaluation of a Cast Article>

Cast articles obtained above were evaluated for defects on the surface thereof by scoring. The scoring was performed as follows: a cast article was axially divided into sixteen areas; each of areas was evaluated for surfaces of the upper mold side and the lower mold side, and scored in terms of possible defects; and scores were counted for comparison. For each of defects (1) to (9) below, a score in an area was set to 1 when not present and −1 when presents. A perfect score is therefore 9 for an area and 9×16=144 for the whole cast article. A total score was multiplied by 100/144 so that the perfect score for the whole cast is 100. Results are shown in Table 2.

<Surface of the Upper Mold Side>

(1) burnt defect of sand (2) pinhole defect (spherical shape of 1 mm or more)

(3) crater defect (shallow dent of 3 mm or more)

<Surface of the Lower Mold Side>

(4) burnt defect of sand (5) pinhole defect (spherical shape of 1 mm or more)
(6) crater defect (shallow dent of 3 mm or more)
<Cross Section>
(7) burnt defect of sand
(8) pinhole defect (spherical shape of 1 mm or more)
(9) crater defect (shallow dent of 3 mm or more)

TABLE 2

| | | Slurry composition Solid material of slurry composition (41.7mass %*1) | | | | | | | | | | |
|---|---|---|---|---|---|---|---|---|---|---|---|---|
| | | Inorganic particle | | Inorganic fiber | | Thermosetting resin | | Heat-expandable particles | | | Water-soluble polymer | |
| | | Kind | mass %*2 | Kind | mass %*2 | Kind | mass %*2 | Kind | heat expansion starting point (° C.) | mass %*2 | Kind | mass %*2 |
| Experiment | 11 | Artificial graphite | 74 | Carbon fiber | 12 | Phenolic resin | 10 | Heat exapndable particle 1 | 75 | 2 | CMC | 2 |
| | 12 | Artificial graphite | 74 | Carbon fiber | 12 | Phenolic resin | 10 | Heat exapndable particle 1 | 75 | 2 | CMC | 2 |
| | 13 | Artificial graphite | 74 | Carbon fiber | 12 | Phenolic resin | 10 | Heat exapndable particle 1 | 75 | 2 | CMC | 2 |
| | 14 | Artificial graphite | 74 | Carbon fiber | 12 | Phenolic resin | 10 | Heat exapndable particle 1 | 75 | 2 | CMC | 2 |
| | 15 | Amorphous graphite | 74 | Carbon fiber | 12 | Phenolic resin | 10 | Heat exapndable particle 1 | 75 | 2 | CMC | 2 |
| | 16 | Artificial graphite | 74 | Carbon fiber | 12 | Phenolic resin | 10 | Heat exapndable particle 1 | 75 | 2 | CMC | 2 |
| | 17 | Artificial graphite | 74 | Carbon fiber | 12 | Phenolic resin | 10 | Heat exapndable particle 1 | 75 | 2 | CMC | 2 |
| | 18 | Artificial graphite | 74 | Carbon fiber | 12 | Phenolic resin | 10 | Hea exapndable particle 2 | 130 | 2 | CMC | 2 |
| | 19 | Amorphous graphite | 74 | Carbon fiber | 12 | Phenolic resin | 10 | Heat exapndable particle 2 | 130 | 2 | CMC | 2 |
| | 20 | Amorphous graphite | 74 | Carbon fiber | 12 | Phenolic resin | 10 | Heat exapndable particle 2 | 130 | 2 | CMC | 2 |
| | 21 | Artificial graphite | 74 | Carbon fiber | 12 | Phenolic resin | 10 | Heat exapndable particle 2 | 130 | 2 | CMC | 2 |
| | 22 | Artificial graphite | 74 | Carbon fiber | 12 | Phenolic resin | 10 | Heat exapndable particle 2 | 130 | 2 | CMC | 2 |
| | 23 | Artificial graphite | 74 | Carbon fiber | 12 | Phenolic resin | 10 | Heat exapndable particle 1 | 75 | 2 | CMC | 2 |
| | 24 | Artificial graphite | 74 | Carbon fiber | 12 | Phenolic resin | 10 | Heat exapndable particle 1 | 75 | 2 | CMC | 2 |

| | | Slurry composition | | | Structure for producing cast articles | | Cast article |
|---|---|---|---|---|---|---|---|
| | | Dispersing medium (58.3mass %*1) | | Difference*3 between boiling point and heat expansion | | | |
| | | Kind | boiling point (° C.) | starting point (° C.) | Density (g/cm³) | Gas permeability | Score (point) |
| Experiment | 11 | Water | 100 | 25 | 0.71 | 42 | 94 |
| | 12 | Water | 100 | 25 | 0.74 | 33 | 84 |
| | 13 | Water | 100 | 25 | 0.78 | 21 | 86 |
| | 14 | Water | 100 | 25 | 0.80 | 17 | 85 |
| | 15 | Water | 100 | 25 | 0.81 | 16 | 87 |
| | 16 | Water | 100 | 25 | 0.90 | 8 | 81 |
| | 17 | xylene | 140 | 65 | 0.75 | 30 | 83 |
| | 18 | Water | 100 | −30 | 0.70 | 5 | 64 |
| | 19 | Water | 100 | −30 | 0.75 | 2 | 55 |
| | 20 | Water | 100 | −30 | 0.79 | 2 | 53 |
| | 21 | Water | 100 | −30 | 0.81 | 2 | 53 |
| | 22 | Water | 100 | −30 | 0.85 | 2 | 51 |

TABLE 2-continued

| | | | | | | |
|---|---|---|---|---|---|---|
| 23 | acetone | 56.5 | −18.5 | 0.75 | 2 | 52 |
| 24 | dichloromethane | 40.2 | −34.8 | 0.78 | 2 | 54 |

*1% by mass in a slurry composition

*2% by mass to a total of inorganic particles, inorganic fiber, thermosetting resin, heat-expandable particles and water-soluble polymer compound (a total mass of a slurry composition)

*3Boiling point of a dispersing medium (° C.)-heat expansion-starting point of heat expandable particles(° C.)

As shown in Table 2, hollow bar-like articles (structures for producing cast articles) of Experiments 11 to 17, which used a dispersing medium having a boiling point not lower than a heat expansion starting point of heat-expandable particles, had appropriate gas permeability and could produce a cast article in which defects (burnt defect of sand, pinhole defect, crater defect) derived from gas defect of the cast article were significantly reduced. In contrast it is also shown that hollow bar-like articles (structures for producing cast articles) of Experiments 18 to 24, which used a dispersing medium having a boiling point not higher than a heat expansion starting point of heat-expandable particles, had insufficient gas permeability and could not produce a cast article in which generation of defects were sufficiently reduced. It is noted that a tendency of increasing score of a cast article with higher gas permeability (larger value of a gas permeability) can be read from the results in Table 2, although the gas permeability and the score of a cast article are not fully-correlated each other due to variations in a pouring temperature of molten metal in casting, a pouring time and weather conditions (particularly humidity).

The invention claimed is:

1. A method for producing a structure for producing cast articles having a gas permeability of 6 to 275 based on JIS (Japanese Industrial Standard) Z2601 comprising the steps of:

dispersing a composition for structure for producing cast articles, comprising one or more inorganic particles selected from the group consisting of amorphous graphites and artificial graphites, the graphites having an average particle diameter of 120 to 800 μm, an inorganic fiber and, a thermosetting resin, in a dispersing medium to prepare a mold material in a dough state;

filling a forming mold with the mold material in the dough state; and heating the forming mold to cure the thermosetting resin to form the structure, so that the structure for producing cast articles has a gas permeability of 6 to 275 based on said JIS Z2601 standard, wherein a shape factor of the inorganic particles is 2.3 to 1.0, the shape factor being equal to $(\text{boundary length})^2/(4\pi*\text{area})$.

2. The method for producing a structure for producing cast articles according to claim 1, wherein heat-expandable particles is further dispersed in the dispersing medium to produce the mold material further comprising the heat-expandable particles, and the mold material is formed by expansion of the heat-expandable particles with heating the forming mold.

3. The method for producing a structure for producing cast articles according to claim 1, wherein the composition further comprising organic fibers in amount of not more than 0.1% by mass.

4. The method for producing a structure for producing cast articles according to claim 1, wherein the structure further comprises heat-expandable particles.

5. The method for producing a structure for producing cast articles according to claim 1, wherein the structure further comprises a water-soluble polymer compound.

6. The method for producing a structure for producing cast articles according to claim 5, wherein the water-soluble polymer compound is polysaccharide as a thickening agent.

7. The method for producing a structure for producing cast articles according to claim 1, wherein the inorganic fiber is carbon fiber.

8. The method for producing a structure for producing cast articles according to claim 1, wherein the structure is a core.

9. The method for producing a structure for producing cast articles according to claim 8, wherein the core is a hollow core.

10. The method for producing a structure for producing cast articles according to claim 1, wherein the inorganic particle is the artificial graphite.

11. The method for producing a structure for producing cast articles according to claim 1, wherein the average particle diameter of the graphites is 120 to 425 μm.

12. The method for producing a structure for producing cast articles according to claim 1, wherein the thermosetting resin is phenolic resin.

13. The method for producing a structure for producing cast articles according to claim 1, wherein the average fiber length of the inorganic fiber is 1 to 8 mm.

14. The method for producing a structure for producing cast articles according to claim 1, wherein the content of the inorganic particle is 50 to 85% by mass.

15. The method for producing a structure for producing cast articles according to claim 1, wherein the content of the inorganic fiber is 2 to 16% by mass.

16. The method for producing a structure for producing cast articles according to claim 1, wherein the content of the thermosetting resin is 2 to 20% by mass.

* * * * *